US012460509B2

(12) United States Patent
Fripp et al.

(10) Patent No.: US 12,460,509 B2
(45) Date of Patent: Nov. 4, 2025

(54) CURVED FLOW TUBE TO SLOW A CLOSURE OF A FLOW VALVE

(71) Applicant: Halliburton Energy Services, Inc., Houston, TX (US)

(72) Inventors: Michael Linley Fripp, Singapore (SG); Hadi Arabnejad Khanouki, Frisco, TX (US); David Allen Dockweiler, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 18/535,003

(22) Filed: Dec. 11, 2023

(65) Prior Publication Data

US 2025/0188818 A1 Jun. 12, 2025

(51) Int. Cl.

| | |
|---|---|
| ***E21B 34/06*** | (2006.01) |
| ***E21B 34/14*** | (2006.01) |
| ***E21B 34/16*** | (2006.01) |
| *E21B 34/10* | (2006.01) |

(52) U.S. Cl.
CPC ..... *E21B 34/16* (2013.01); *E21B 34/14* (2013.01); *E21B 34/066* (2013.01); *E21B 34/10* (2013.01); *E21B 2200/05* (2020.05)

(58) Field of Classification Search
CPC ..... E21B 34/14; E21B 34/066; E21B 34/10; E21B 34/16; E21B 2200/05
See application file for complete search history.

(56) References Cited

U.S. PATENT DOCUMENTS

| | | | |
|---|---|---|---|
| 4,427,071 | A | 1/1984 | Carmody |
| 4,531,587 | A | 7/1985 | Fineberg |
| 4,597,446 | A | 7/1986 | Helderle |
| 4,605,075 | A | 8/1986 | Radford et al. |
| 4,890,674 | A | 1/1990 | Le |
| 4,977,957 | A | 12/1990 | Pringle |
| 5,137,090 | A | 8/1992 | Hare et al. |
| 6,315,047 | B1 | 11/2001 | Deaton et al. |
| 7,363,980 | B2 | 4/2008 | Pringle |
| 7,708,066 | B2 | 5/2010 | Frazier |
| 7,762,336 | B2 | 7/2010 | Johnson et al. |

(Continued)

OTHER PUBLICATIONS

Weisstein, Eric W. "Roulette." From MathWorld—A Wolfram Web Resource. https://mathworld.wolfram.com/Roulette.html (Year: 2023).*

(Continued)

*Primary Examiner* — Blake Michener
(74) *Attorney, Agent, or Firm* — Kilpatrick Townsend & Stockton, LLP

(57) ABSTRACT

A curved flow tube can be positioned in a tubing string deployed downhole in a wellbore to slow a closure of a flow valve in the tubing string. The tubing string can be deployed in the wellbore to transport wellbore fluid. The flow valve can be coupled to the tubing string. Additionally, the flow valve can include a flapper and the flow tube. The flapper can be positioned to control the wellbore fluid transported through the tubing string. The flapper may be adjusted between an open position and a closed position. The flow tube can include a downhole end that has a curvature to slow a closure rate corresponding to adjusting the flapper from the open position to the closed position.

20 Claims, 5 Drawing Sheets

(56) References Cited

U.S. PATENT DOCUMENTS

| | | | |
|---|---|---|---|
| 8,261,836 | B2 | 9/2012 | Noske et al. |
| 9,027,581 | B2 | 5/2015 | Butler |
| 9,212,536 | B2 | 12/2015 | Biddick et al. |
| 2002/0070028 | A1 | 6/2002 | Garcia et al. |
| 2002/0079104 | A1 | 6/2002 | Garcia et al. |
| 2008/0156497 | A1 | 7/2008 | Kalb et al. |
| 2008/0271883 | A1 | 11/2008 | Barton et al. |
| 2009/0229829 | A1 | 9/2009 | Lloyd et al. |
| 2010/0139923 | A1 | 6/2010 | Biddick et al. |
| 2013/0008667 | A1 | 1/2013 | Noske et al. |
| 2015/0204163 | A1 | 7/2015 | Hill et al. |
| 2023/0296000 | A1 | 9/2023 | Bucciarelli et al. |
| 2024/0026751 | A1 | 1/2024 | Helms et al. |

OTHER PUBLICATIONS

International Patent Application No. PCT/US2023/076164, International Search Report and Written Opinion mailed Jun. 25, 2024, 10 pages.

International Patent Application No. PCT/US2023/083315, International Search Report and Written Opinion mailed Sep. 10, 2024, 10 pages.

* cited by examiner

CURVED FLOW TUBE TO SLOW A CLOSURE OF A FLOW VALVE

TECHNICAL FIELD

The present disclosure relates generally to wellbore tools and, more particularly (although not necessarily exclusively), to a curved flow tube to slow a closure of a flow valve in a downhole environment.

BACKGROUND

A wellbore can be formed in a subterranean formation for extracting produced hydrocarbon or other suitable material. A wellbore operation can be performed to extract the produced hydrocarbon material. During a wellbore completion operation, a tubing string can be deployed in the wellbore to transport downhole fluid of the wellbore through the tubing string. The tubing string can include a flow valve to control fluid flow through the tubing string. The flow valve can include a flapper-seat assembly that can prevent backflow of a downhole fluid from the wellbore to a well surface. The flapper-seat assembly can include a flapper and a seat. The seat can generate a tight seal for the flow valve. Malfunctions associated with the flapper-seat assembly may lead to delays or costly repairs associated with for the wellbore operation.

DETAILED DESCRIPTION

Figure 1:
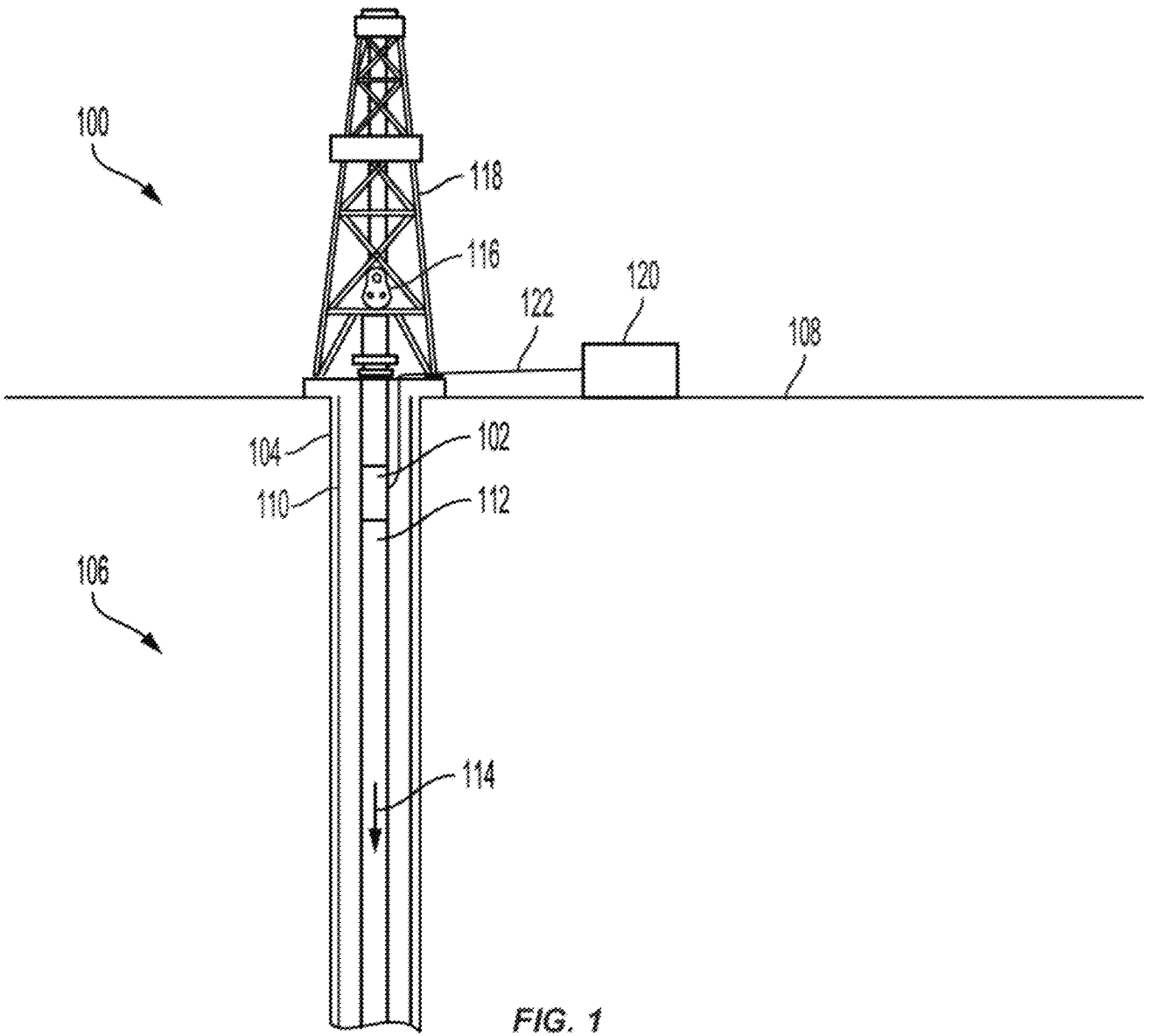
FIG. 1 is a schematic of a wellsite including a flow valve with a curved flow tube to slow a closure of the flow valve according to some aspects of the present disclosure.

Certain aspects and examples of the present disclosure relate to a curved flow tube to slow a closure of a flow valve in a downhole environment. The flow tube can be part of a tubing string that can be deployed downhole in a wellbore to facilitate transport of downhole fluid in the wellbore. The flow valve can control a flow of the downhole fluid through the flow tube based on a position of the flow valve. For instance, the flow valve can include a flapper-seat assembly with a flapper that can couple to a seat in a closed position of the flow valve to seal the tubing string. The flow tube can include a downhole end that can adjust the position of the flapper of the flow valve. The downhole end of the flow tube can have a curvature to slow the closure of the flapper. The curvature of the downhole end of the flow tube can support the flapper to gradually adjust the flapper to a closed position that can prevent backflow of the downhole fluid. Due to the curvature of the downhole end, one section of the downhole end can have a longer length compared to another section of the downhole end.

The curvature of the downhole end can reduce or prevent deformation of the flow valve by slowing a closure rate associated with adjusting the flow valve from an open position to the closed position. In the open position, the flapper of the flow valve may be positioned in a housing (e.g., a recessed portion of the housing) of the tubing string. Additionally, the downhole end of the flow tube can be positioned farther downhole past the flapper such that a body of the flow tube prevents the flapper from moving into the closed position. Accordingly, to adjust the flow valve into the closed position, the flow tube can be retracted toward a well surface of the wellbore.

As the flow tube retracts, the flapper of the flow valve may rotate from the housing using a hinge coupling the flapper to the housing such that the flapper contacts the downhole end of the retracting flow tube. The curvature of the downhole end of the flow tube can ensure that the flapper remains in contact with the retracting flow tube until the flapper is in the closed position. As a result, the flow tube can support the flapper to enable the flapper to gradually assume the closed position, thereby preventing the flapper from forcibly contacting the seat or the downhole end of the flow tube after the flow tube retracts. Additionally, the support provided by the flow tube can reduce stress on the hinge or the flapper of the flow valve. Once the flapper is in the closed position, the flapper can couple to the seat of the flow valve to seal the flow valve and prevent the wellbore fluid from flowing through the flow valve. Slowing the closure rate of the flapper can reduce stress or damage to a sealing surface of the flapper-seat assembly, thereby extending longevity and improving reliability of the flow valve.

To open the flow valve, the flow tube can be deployed downhole to apply a pushing force to the flapper such that the flapper rotates into the open position. The longer section of the downhole end can be positioned farther from the hinge than the shorter section of the downhole end. Accordingly, the longer section of the downhole end can provide initial contact with the flapper using a higher moment arm compared to a flat-faced flow tube, resulting in less force used to open the flapper. The material used to produce the downhole end of the flow tube can be softer than the material of the flapper such that the downhole end of the flow tube can be relatively unlikely to damage or deform the flapper when applying the pushing force.

In some cases, if the closure rate associated with the flow valve is outside of a predefined range, the flow valve may experience deformation that can hinder performance of the flow valve, for example resulting in seal failure of the flow valve. For example, if the closure rate is below the predefined range (e.g., a relatively slow closure rate), pressure can build in the tubing string, causing excessive force on the hinge of the flow valve. The excessive force can shear or otherwise deform the hinge or the flapper. Alternatively, if the closure rate is above the predefined range (e.g., a relatively fast closure rate), the flow valve can experience a forceful closure that can deform a sealing surface of the flapper-seat assembly. In some cases, the forceful closure additionally can deform the hinge, such as due to rebound of the forceful closure. Implementing the curved flow tube can control the closure rate of the flow valve to be within the predefined range. For example, the curvature of the curved flow tube can be adjusted to slow or speed up the closure rate by having a movement of the flapper match the curvature of the curved flow tube, thereby minimizing or preventing the deformation of the flow valve.

Adjusting the curvature of the downhole end can modify the closure rate of the flow valve. Determining the curvature of the downhole end can depend on one or more factors associated with the flow valve, for example a pressure level in the wellbore. If the pressure level of the wellbore is relatively high, a closing force acting on the flow tube can be relatively strong such that a flat-faced flow tube avoids contact with the flapper. Accordingly, the curvature of the flow tube can be increased (e.g., deepened) to ensure that the flapper remains in contact with the flow tube to slow the closure rate of the flow valve. Additionally or alternatively, the closure rate can be affected by one or more fluidic dampers that can be added to the flow tube. Examples of the fluidic dampers can include nozzles or other suitable flow restrictors. The fluidic dampers can adjust a flow rate of hydraulic fluid that can be used to move the flow tube. In some cases, a viscosity of the hydraulic fluid used provide hydraulic forces to move the flow tube can be adjusted such that the closure rate can be modified.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellsite 100 including a flow valve 102 with a curved flow tube to slow a closure of the flow valve 102 according to some aspects of the present disclosure. As depicted in FIG. 1, the wellsite 100 includes the wellbore 104 drilled through a subterranean formation 106. The wellbore 104 extends from a well surface 108 into strata of the subterranean formation 106. The strata can include different materials (e.g., rock, soil, oil, water, gas, etc.) and can vary in thickness and shape. In some examples, the wellsite 100 may include more than one wellbore 104. Additionally, the wellbore 104 can be vertical as depicted, deviated, horizontal, or any combination thereof.

The wellbore 104 can be cased, open-hole, or a combination thereof. For example, a casing string 110 can extend from the well surface 108 through the subterranean formation 106. The casing string 110 can be piping implemented to protect or structurally strengthen the wellbore 104. In some examples, the casing string 110 can be coupled to walls of the wellbore 104 via annular material, such as cement. A tubing string 112 can be positioned in the casing string 110 to provide a conduit through which a wellbore fluid 114 (e.g., production fluid, formation fluid, treatment fluid, etc.), can travel between the wellbore 104 and the well surface 108. In some cases, the tubing string 112 can be deployed downhole in the wellbore 104 by a winch 116 in a derrick 118 positioned above the well surface. In other cases, the tubing string 112 may be positioned in the wellbore 104 in another manner. Examples of materials used to produce the tubing string 112 can include carbon steel, aluminum, or other material suitable for downhole conditions. In some cases, the wellbore fluid 114 can be downhole fluid that can be transported from a downhole region in the wellbore 104 to the well surface 108 through the tubing string 112.

In some examples, the tubing string 112 can include the flow valve 102 (e.g., a flapper valve) to control a fluid flow of the wellbore fluid 114. As an example, the flow valve 102 can be part of a downhole tool deployed downhole in the wellbore 104 via the tubing string 112. In some examples, the flow valve 102 can be part of a tubing conveyed valve having a body coupled to the tubing string 112 using threads. In other examples, the flow valve 102 may be part of an insert valve that can include a body coupled to the tubing string 112 by inserting the insert valve via a wireline. The insert valve can be positioned in the tubing string 112 after the tubing string 112 is installed in the wellbore 104. In a closed position, the flow valve 102 can prevent the wellbore fluid 114 from flowing through the tubing string 112. For example, if the wellbore fluid 114 is being pumped downhole into the wellbore 104, the flow valve 102 can prevent the wellbore fluid 114 from backflowing from the wellbore 104 to the well surface 108. By controlling the fluid flow of the wellbore fluid 114, the flow valve 102 can minimize malfunctions associated with a wellbore operation (e.g., a production operation, a completion operation, etc.). Examples of the malfunctions can include uncontrolled release of the wellbore fluid 114, damage to a production-control facility 120 positioned above the well surface 108, or other hazardous conditions. The production-control facility 120 can include operators or computing systems to monitor or control the wellbore operation. In some examples, the flow valve 102 can be designed to isolate the wellbore 104 in response to system failure or damage to the production-control facility 120.

In some cases, the flow valve 102 may move from the closed position to an open position due to a downhole pressure in the wellbore 104 exceeding a cracking pressure associated with the flow valve 102. The cracking pressure can correspond to a minimum pressure differential between an inlet and an outlet of the flow valve at which the wellbore fluid 114 can begin to flow through the flow valve 102. Additionally or alternatively, a flow tube can be part of the tubing string 112 and can be used to adjust the flow valve 102 between the open position and the closed position. At least one end of the flow tube can have a curvature to slow the closure of the flow valve. The flow tube is described in further detail below with respect to FIGS. 2-4.

In some cases, a control line 122 can be coupled to the flow valve 102 to control the flow valve 102 from the well surface 108 (e.g., at the production-control facility 120). The control line 122 can be positioned external to the tubing string 112 in the wellbore 104 to communicatively couple the production-control facility 120 and the flow valve 102. As an example, the control line 122 may provide hydraulic forces to adjust the flow valve 102 between the open position and the closed position by moving the flow tube. Additionally or alternatively, the control line 122 may actuate the flow valve 102 with electrical signals, optical signals, or other suitable signals. The control line 122 can be energized (e.g., with pressure or with voltage) to ensure that the flow valve 102 can operate on a fail-safe basis. In some cases, if the control line 122 loses pressure (e.g., due to a leak or a system failure), the flow valve 102 can automatically close due to the pressure loss of the control line 122. In some examples, the flow valve 102 may be actuated by an automated process executed within the flow valve 102 instead of by the control line 122.

Although the flow valve 102 is described as being controlled from the well surface 108 using the control line 122, it will be appreciated that the flow valve 102 can be controlled using a subsurface controller. The subsurface controller can actuate the flow valve 102 (e.g., using hydraulic forces) to adjust the position of the flow valve 102. Additionally or alternatively, the subsurface controller can use flow rate changes of the wellbore fluid 114 to adjust the position of the flow valve 102 (e.g., close the flow valve 102 in response to an increase in a flow rate of the wellbore fluid 114).

Figure 2:
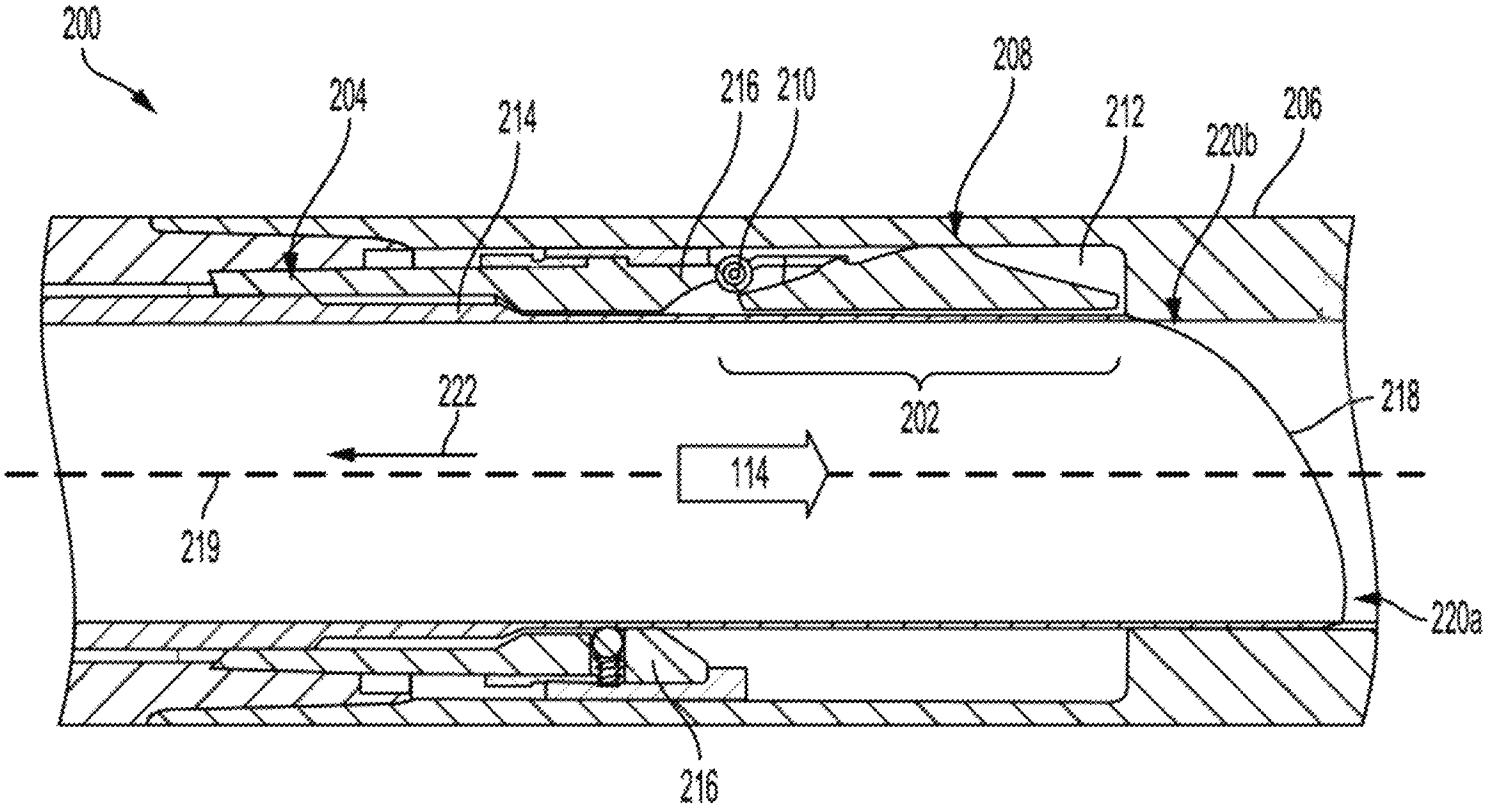
FIG. 2 is an example of a cross-sectional view of a flow valve positioned in a tubing string in an open position with a curved flow tube according to some aspects of the present disclosure.

FIG. 2 is an example of a cross-sectional view of a flow valve 200 positioned in a tubing string 112 in an open position 202 with a curved flow tube 204 according to some aspects of the present disclosure. The flow valve 200 can be positioned in the tubing string 112 to control a fluid flow of a wellbore fluid 114 in a downhole environment beneath a well surface 108. In some implementations, the flow valve 200 can correspond to the flow valve 102 of FIG. 1. FIG. 2 is described below with reference to components of FIG. 1.

In some examples, the flow valve 200 can be a check valve that can ensure that the wellbore fluid 114 travels in one direction (e.g., in a downhole direction) by closing if the wellbore fluid 114 stops flowing or reverses direction. For example, a housing 206 of the flow valve 200 can include a flapper 208 that can be coupled to the housing 206 via a hinge 210. In some cases, the flapper 208 can be referred to as a disc or a plate. Although the flow valve 200 is described as including the flapper 208, it will be appreciated that other types of check valves or control valves are possible.

In the open position 202, the flapper 208 can be positioned in a recess 212 defined in the housing 206 of the flow valve 200. When the flow valve 200 is in the open position 202, the flow tube 204 can be positioned such that a body 214 of the flow tube 204 blocks the recess 212, thereby preventing the flapper 208 from moving into a closed position. The closed position of the flow valve 200 is described in further detail below with respect to FIG. 4. Additionally or alternatively, by blocking the recess 212, the flow tube 204 can protect the flapper 208 from the wellbore fluid 114 that can flow through the tubing string 112. The hinge 210 can enable the flapper 208 to be rotatably adjusted between the open position 202 and the closed position. For example, the flapper 208 may rotate about 90° to be adjusted from the open position 202 to the closed position. In the closed position, the flapper 208 can couple to a seat 216 of the flow valve 200 to generate a seal that can prevent the wellbore fluid 114 from backflowing.

The flow tube 204 can include a downhole end 218 that has a curvature to slow the closure of the flow valve 200. The downhole end 218 can be referred to as a nose or a face of the flow tube 204. In some examples, the downhole end 218 can have a geometric shape that represents a planar curve. As an example, the planar curve can have a planar surface with a single curve. In some examples, the single-curved planar surface can be a flat plane positioned at an acute angle with respect to an axis (e.g., a longitudinal axis 219) of the flow tube 204. Additionally or alternatively, the curvature of the downhole end 218 can correspond to a roulette curve (e.g., a cycloid, trochoid, etc.). Additional examples of the curvature of the downhole end 218 can include a polynomial curve or a piecewise linear curve. In examples in which the planar curve of the downhole end 218 corresponds to a roulette curve, the roulette curve can be generated by a point on a first curve that is rolled without slipping along a second curve that is fixed in place.

The curvature of the downhole end 218 can be defined based on a first section 220*a* of the downhole end 218 having a different length than a second section 220*b* of the downhole end 218. In some examples, the flow tube 204 can have a cylindrical shape with a base corresponding to the downhole end 218. A cross section of the flow tube 204 through a center of the flow tube 204 along the longitudinal axis 219 of the flow valve 200 can divide the flow tube into a first portion and a second portion. The sections 220*a-b* of the downhole end 218 can correspond to a respective portion of the downhole end 218. In some examples, a first length of the first section 220*a* can be longer than a second length of the second section 220*b*. The lengths of the sections 220*a-b* of the downhole end 218 can correspond to a respective distance each section (e.g., the first section 220*a* and the second section 220*b*) extends downhole.

Additionally, the second section 220*b* of the downhole end 218 can be positioned closer to the hinge 210 of the flow valve 200 than the first section 220*a* of the downhole end 218. Similarly, the first section 220*a* of the downhole end 218 can be positioned farther away from the hinge 210 of the flow valve 200 than the second section 220*b* of the downhole end 218. In particular, the first section 220*a* can be positioned distal from a center of rotation of the flow valve 200 that can correspond to the hinge 210 of the flow valve 200. In some examples, a straight line connecting the first section 220*a* of the downhole end 218 and the second section 220*b* of the downhole end 218 can form an acute angle (e.g., an angle of less than) 90° with the longitudinal axis 219 of the flow tube 204.

To adjust the flow valve 200 from the open position 202 to the closed position, the flow tube 204 can be retracted or adjusted in an uphole direction 222. In some cases, a closing force can act on the flow tube 204 to move the flow tube 204 in the uphole direction 222 such that the flow valve 200 can assume the closed position. A closure rate of the flapper 208 can depend at least in part on the closing force acting on the flow tube 204. In some examples, a power spring (not pictured) can be positioned in the housing 206 of the flow valve 200 to provide the closing force. As the flow tube 204 is moved downhole to open the flow valve 200, the power spring can be compressed (e.g., via a piston actuated by a control line 122).

Once the control line 122 stops actuating the piston, the power spring can exert a spring force as the closing force to retract the flow tube 204 in the uphole direction 222. The spring force exerted by the power spring can depend on a stiffness of the power spring, a spring stroke of the power spring, or a combination thereof. The stiffness of the power spring can correspond to a spring constant associated with the power spring such that a relatively high spring constant can correspond to the power spring being relatively stiff. Accordingly, a stiffer power spring can require a larger force to deform (e.g., compress or stretch) the stiff power spring compared to a softer power spring. The spring stroke of the power spring can indicate an amount (e.g., distance) of deformation that the power spring can undergo.

In some cases, after an initial movement of the flow tube 204 caused by the closing force, hydraulic forces in the flow valve 200 can catch the flapper 208 to assist with adjusting the flapper 208 to the closed position. For example, after the flow tube 204 has moved a predefined distance in the uphole direction 222, the hydraulic forces can continue with a closing action associated with adjusting the flapper 208 to the closed position. Accordingly, in such cases, the power spring can be designed to be relatively stiff to provide a relatively high closing force that can move the flapper 208 by at least the predefined distance. Additionally or alternatively, a nonlinear spring that is relatively stiff initially but softer after the initial movement of the flow tube 204 can be used as the power spring.

Figure 3:
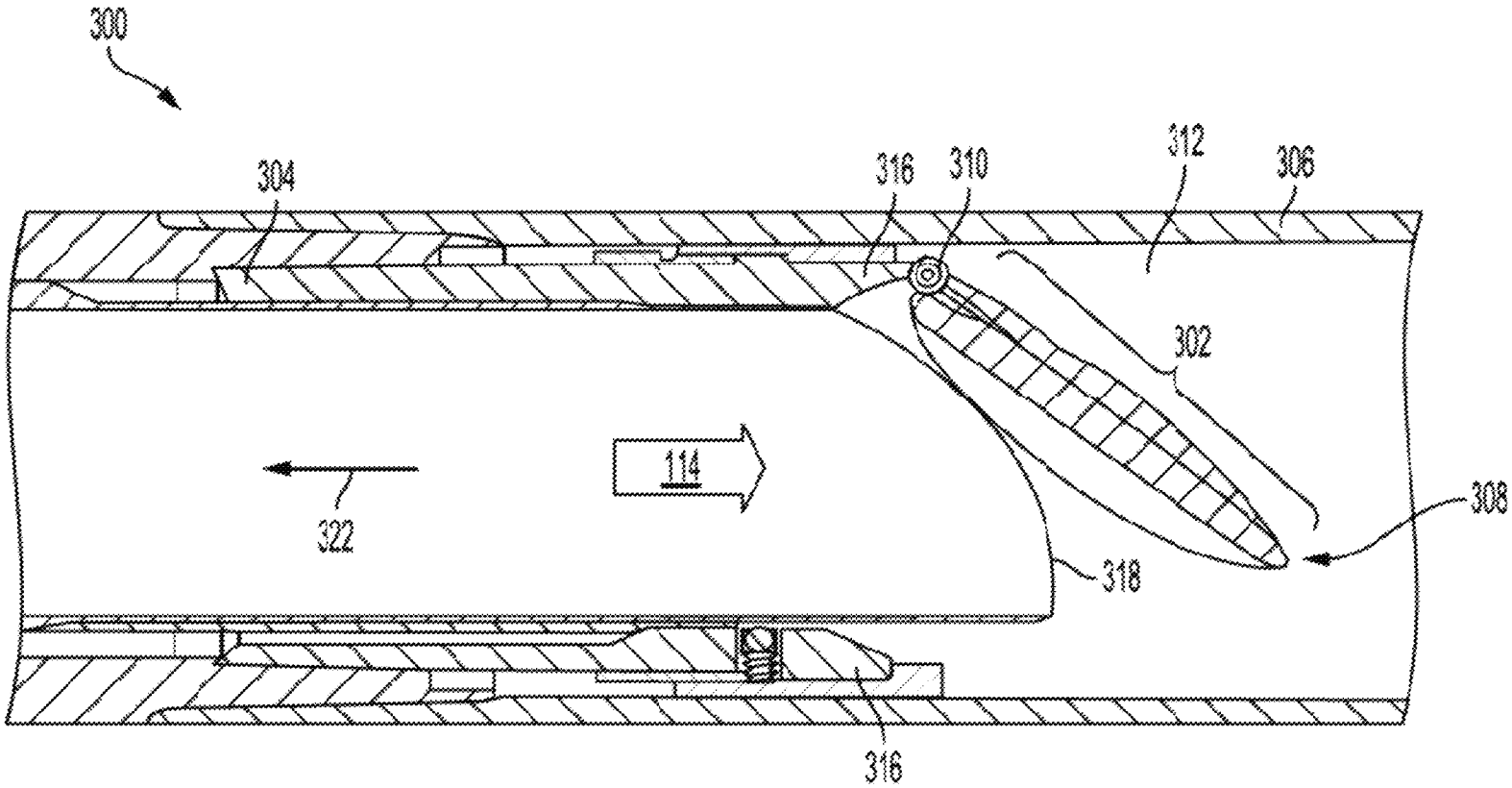
FIG. 3 is an example of a cross-sectional view of a flow valve positioned in a tubing string in an intermediate position supported by a curved flow tube according to some aspects of the present disclosure.

As the flow tube 204 is withdrawn in the uphole direction 222, the downhole end 218 can move past the flapper 208, thereby unblocking the recess 212. The flapper 208 then can begin to rotate from the recess 212 until the flapper 208 contacts the seat 216, causing a seal (e.g., a metal-to-metal seal) to form in the tubing string 112. Due to the curvature of the downhole end 218, the downhole end 218 of the flow tube 204 can support the flapper 208 as the flapper 208 rotates into the closed position from the recess 212. For example, FIG. 3 depicts a cross-sectional view of a flow valve 300 in an intermediate position 302 supported by a flow tube 304. In some cases, the flow valve 300 can correspond to the flow valve 102 of FIG. 1. The intermediate position 302 can correspond to a position of a flapper 308 of the flow valve 300 being between an open position (e.g., described above with respect to FIG. 2) and a closed position (e.g., described below with respect to FIG. 4). As an example, in the intermediate position 302, the flapper 308 can be positioned outside of a recess 312 defined in a housing 306 of the flow valve 300 but not coupled to the seat 316 of the flow valve 300.

As depicted in FIG. 3, the flapper 308 can be in contact with a downhole end 318 of the flow tube 304 as the flapper 308 rotates on a hinge 310 from the recess 312 of the flow valve 300. Accordingly, the downhole end 318 of the flow tube 304 can temper or moderate a closure rate of the flapper 308. For example, the closure rate of the flapper 308 can match or correspond to a retraction rate at which the flow tube 304 moves in an uphole direction 322. In some examples, the retraction rate can be determined to ensure that the flapper 308 remains in contact with the downhole end 318 until the flapper 308 contacts the seat 316. Thus, the curvature of the downhole end 318 can enable a relatively slow closure of the flapper 308 to minimize or avoid deformation of the flow valve 300 (e.g., the seat 316, the flapper 308, or the flow tube 304). In some implementations, the retraction rate can be determined using the curvature of the downhole end 318, a weight of the flapper 308, a distance (e.g., depth) between the flapper 308 and the seat 316, or a combination thereof. Accordingly, by slowing the closure of the flapper 308, the downhole end 318 of the flow tube 304 can prevent damage to the flow valve 300 caused by the flapper 308 forcibly contacting the seat 316 or the flow tube 304.

Returning to FIG. 2, in some cases, the downhole end 218 of the flow tube 204 can be made of a different material than the flapper 208 of the flow valve 200. For example, a first material used to produce the downhole end 218 of the flow tube 204 can have less hardness than a second material used to produce the flapper 208. Additionally, in some examples, the first material used to produce the downhole end 218 may be different from another material used to produce the flow tube 204. Examples of the first material for the downhole end 218 can include metal alloys (e.g., steel, copper, etc.) or polymers (e.g., polytetrafluoroethylene (PTFE), polyether ether ketone (PEEK), etc.). In some implementations, if the first material for the downhole end 218 is a metal alloy, the hardness of the first material can be measured or quantified using a Rockwell scale based on an indentation hardness of the first material. In general, if the first material is a metal alloy, the hardness of the first material can range from 5 HRb to 100 HRb. For instance, if the metal alloy is steel, the hardness of the first material may range from 50 HRb to 100 HRb. As another example, if the metal alloy is a copper alloy, the hardness of the first material may range from 5 HRb to 40 HRb.

In other implementations, if the first material for the downhole end 218 is a polymer, the hardness of the first material can be quantified using a Shore D scale. In general, if the first material for the downhole end 218 is a polymer, the hardness can range from 40 Shore D to 120 Shore D. For instance, if the polymer is PTFE, the hardness of the first material can range from 40 Shore D to 100 Shore D. As another example, if the polymer is PEEK, the hardness of the first material may range from 50 Shore D to 120 Shore D.

The downhole end 218 being softer than the flapper 208 can minimize or reduce damage (e.g., scratches) to the flapper 208, for example when the downhole end 218 pushes against the flapper 208 to adjust the flapper 208 to the open position 202. Additionally, the downhole end 218 being softer than the flapper 208 can reduce friction when adjusting the flapper 208 to the closed position, for example when the flow tube 204 is retracted in the uphole direction 222. In some implementations, the first material of the downhole end 218 can improve sealing provided by the flow tube 204 of the flow valve 200.

Figure 4:
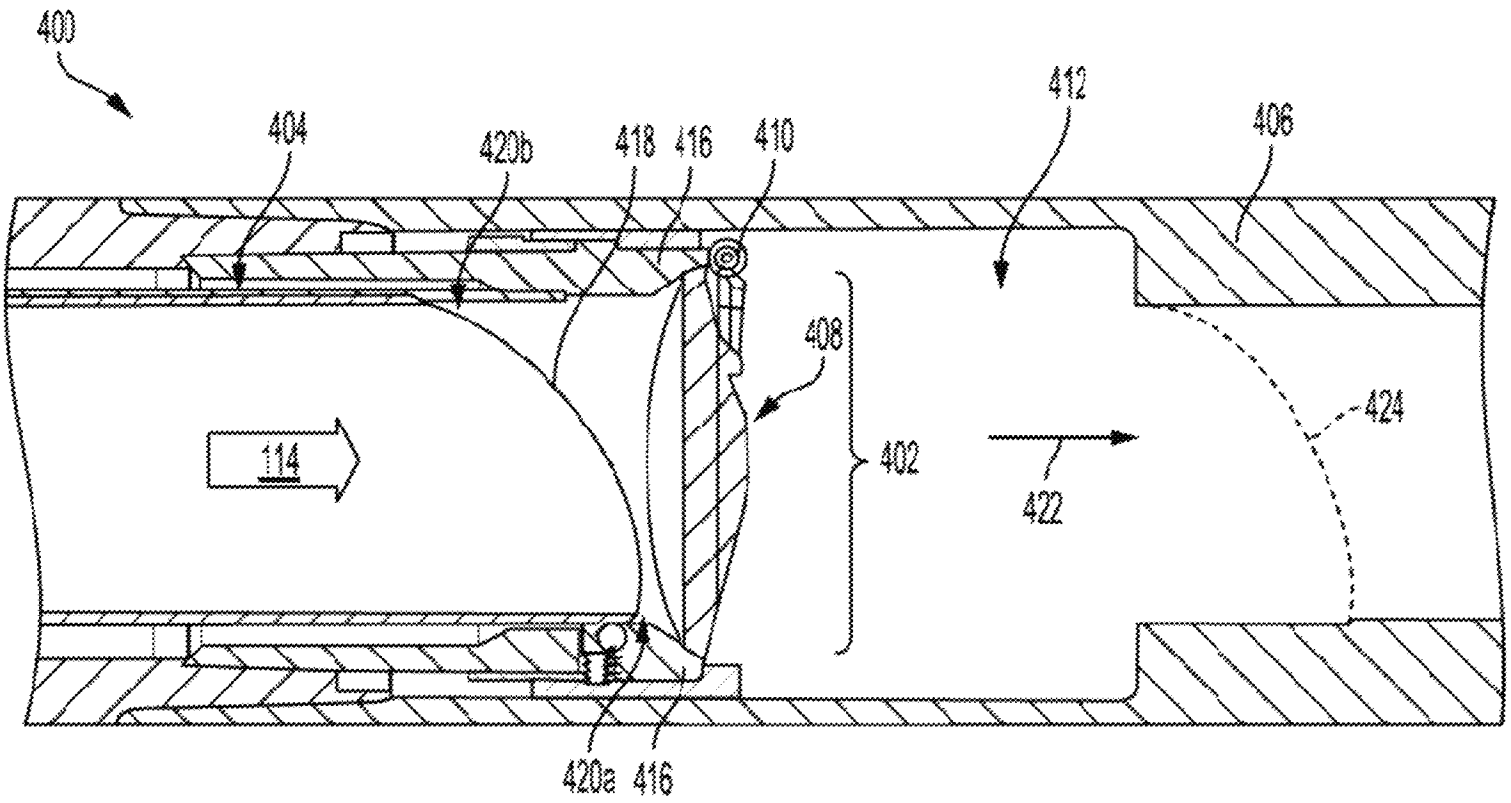
FIG. 4 is an example of a cross-sectional view of a flow valve positioned in a tubing string in a closed position with a curved flow tube according to some aspects of the present disclosure.

FIG. 4 is an example of a cross-sectional view of a flow valve 400 positioned in a tubing string 112 in a closed position 402 with a curved flow tube 404 according to some aspects of the present disclosure. In some cases, the flow valve 400 can be the flow valve 102 of FIG. 1. As depicted in FIG. 4, the flow valve 400 can be a flapper valve that includes a flapper 408 and a seat 416. In the closed position 402, the flapper 408 can be coupled to the seat 416 to generate a seal that prevents a wellbore fluid 114 from flowing through the flow valve 400. FIG. 4 is described below with reference to components of FIGS. 1-3.

To adjust the flow valve 400 from the closed position 402 to an open position 202 (e.g., described above with respect to FIG. 2), the flow tube 404 can be advanced in a downhole direction 422. After advancing a predefined distance downhole, the flow tube 404 can decouple or unseat the flapper 408 from the seat 416, thereby adjusting the flow valve 400 into the open position 202. In some examples, a control line (e.g., the control line 122 of FIG. 1) can provide an opening force to actuate the flow valve using hydraulic fluid. The opening force can cause the flow tube 404 to advance in the downhole direction 422 to adjust the flapper 408 to the open position 202. The hydraulic fluid can actuate a piston positioned in a housing 406 of the flow valve 400 to advance the flow tube 404 in the downhole direction 422. As the flow tube 404 slides downhole, the flow tube 404 can compress a power spring (e.g., the power spring described above with respect to FIG. 2). Once the control line 122 stops providing the opening force, a spring force provided by the compressed power spring can move the flow tube 404 in an uphole direction (e.g., the uphole direction 222 depicted in FIG. 2) to adjust the flow valve 400 from the open position 202 to the closed position 402.

As the flow tube 404 advances in the downhole direction 422, the flow tube 404 can adjust a position of the flow valve 400, for example causing the flapper 408 of the flow valve 400 to rotate into a recess 412 formed by the housing 406. In particular, a downhole end 418 of the flow tube 404 can contact the flapper 408 and provide a pushing force to rotate the flapper 408 via a hinge 410 into the recess 412 as the flow tube 404 advances in the downhole direction 422. In some examples in which a first section **420*a* of the downhole end 418 is longer than a second section 420*b* of the downhole end 418, the first section 420*a* can contact the flapper 408 prior to the second section 420*b*. Additionally, the first section 420*a* of the flow tube 404 can be positioned farther from the hinge 410 than the second section 420*b* such that a smaller pushing force is needed to adjust the position of the flow valve 400 compared to a flat-faced flow tube. The pushing force applied by the flow tube 404 can cause the flapper 408 to reach an intermediate position 302 (e.g., as described above with respect to FIG. 3) prior to assuming the open position 202**.

Once the flow valve 400 is in the open position 202, the flow tube 404 can protect the flapper 408 from the wellbore fluid 114. In some examples, after moving another predefined distance in the downhole direction 422, the downhole end 418 of the flow tube 404 can contact a mating profile 424 defined in the housing 406 of the flow valve 400. The mating profile 424 can be located downhole from the flapper 408 and the seat 416 in the flow valve 400. In some examples, the mating profile 424 can have a second curvature that complements the first curvature of the downhole end 418. After coupling together, the first curvature and the second curvature can enable the flow valve 400 to generate a seal that can protect the flapper 408 by preventing the wellbore fluid 114 from contacting the flapper 408. For example, when the downhole end 418 of the flow tube 404 is coupled to the mating profile 424, the flapper 408 can be in the open position 202, enabling the wellbore fluid 114 to flow through the tubing string 112. Due to the mating profile 424 being positioned farther downhole than the flapper 408, the seal formed between the downhole end 418 and the mating profile 424 can prevent the wellbore fluid 114 from contacting other components (e.g., the flapper 408) of the flow valve 400.

While FIGS. 1-4 depicts a specific arrangement of components, other examples can include more components, fewer components, different components, or a different arrangement of the components shown in FIGS. 1-4. For instance, in other examples, the flow valve 200 may include more than one flapper or a different type of control valve instead of a flapper valve. For example, the flow valve 200 can include a series of flappers positioned to ensure one-directional flow of the wellbore fluid 114.

Figure 5:
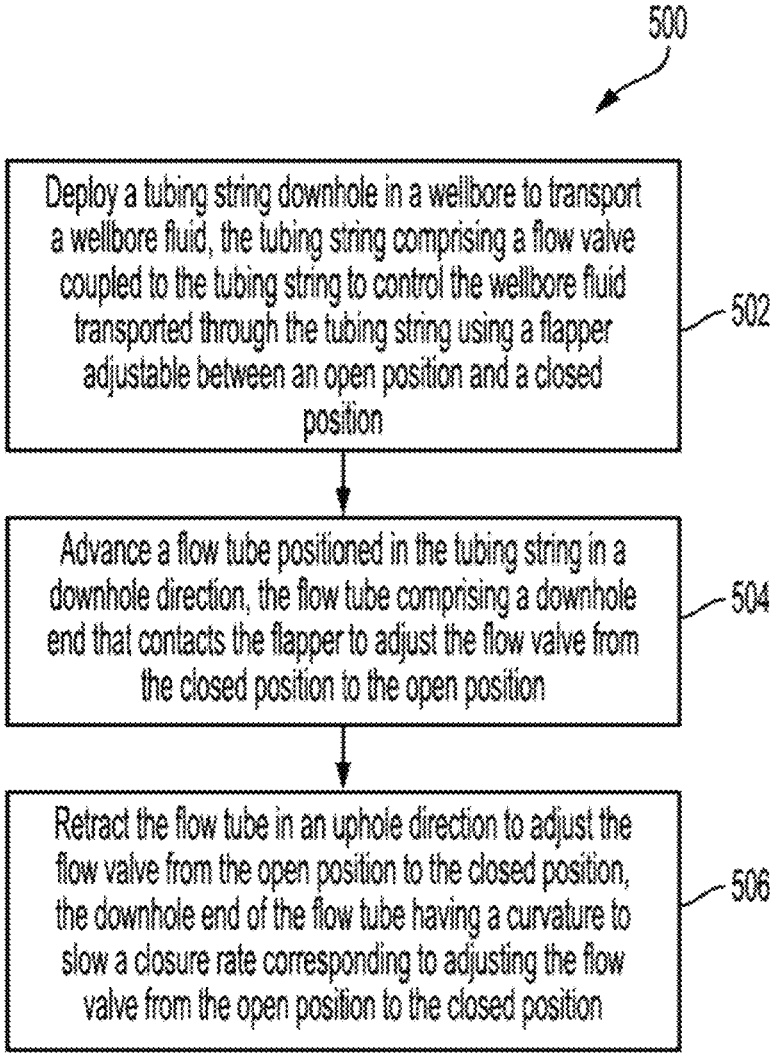
FIG. 5 is a flowchart of a process for adjusting a curved flow tube to modify a position of a flow valve according to some aspects of the present disclosure.

FIG. 5 is a flowchart of a process 500 for adjusting a curved flow tube 204 to modify a position of a flow valve 102 according to some aspects of the present disclosure. Adjusting the flow tube 204 can involve sliding the flow tube 204 in a downhole direction 422 or an uphole direction 222 to open or close the flow valve 102, respectively. The flow valve 102 can be positioned in a tubing string 112 (e.g., part of a downhole tool) deployed in a wellbore 104, for example as described with respect to FIG. 1. While FIG. 5 depicts a certain sequence of steps for illustrative purposes, other examples can involve more steps, fewer steps, different steps, or a different order of the steps depicted in FIG. 5. The steps of FIG. 4 are described below with reference to the components of FIGS. 1-4 described above.

In block 502, the tubing string 112 is deployed downhole in the wellbore 104 to transport a wellbore fluid 114. The tubing string 112 can include the flow valve 102 that can be coupled to the tubing string 112 to control the wellbore fluid 114 being transported through the tubing string 112. In particular, the flow valve 102 can include a flapper 208 adjustable between an open position 202 and a closed position 402. In the closed position 402, the flapper 208 can prevent the wellbore fluid 114 from flowing through the flow valve 102, for example by forming a seal with a seat 216 of the flow valve 102.

In block 504, the flow tube 204 positioned in the tubing string 112 advances in the downhole direction 422. In some examples, a piston can actuate the flow tube 204 to move (e.g., slide) in the downhole direction 422 in response to hydraulic forces provided by a control line 122. The control line 122 can provide the hydraulic forces after receiving communication (e.g., a command or a message) transmitted from a production-control facility 120 positioned above a well surface 108 of the wellbore 104. In some implementations, the hydraulic forces can cause a power spring in the flow valve 102 to compress. When advancing in the downhole direction 422, the flow tube 204 can apply a pushing force to the flapper 208 to adjust the flow valve 102 from the closed position 402 to the open position 202. In particular, the flow tube 204 can include a downhole end 218 that can contact the flapper 208 as the flow tube 204 moves downhole.

In response to the pushing force provided by the flow tube 204, the flapper 208 can transition from the closed position 402 to the open position 202 by rotating via a hinge 210 coupling the flapper 208 to a housing 206 of the flow valve 102. The flapper 208 can reach the open position 202 after the flapper 208 is positioned in a recess 212 defined in the housing 206 of the flow valve 102. Once the flapper 208 is in the open position 202, the flow tube 204 can proceed farther in the downhole direction 422 past the flapper 208. Accordingly, a body 214 of the flow tube 204 can block the recess 212, preventing the flapper 208 from moving into the closed position 402 until the flow tube 204 retracts and unblocks the recess 212. In some examples, the flow tube 204 may advance in the downhole direction 422 until the downhole end 218 contacts a mating profile 424 defined in the housing 206 of the flow tube 204. The mating profile 424 can include a complementary curvature that matches a curvature of the downhole end 218 of the flow tube 204. The complementary curvature can enable the flow tube 204 to form another seal with the housing 206, for example to prevent the wellbore fluid 114 from damaging the flapper 208.

In block 506, the flow tube 204 retracts in the uphole direction 222 to adjust the flow valve 102 from the open position 202 to the closed position 402. To enable the flow tube 204 to retract, the control line 122 can remove the hydraulic forces acting on the piston. In response, the power spring in the flow valve 102 can decompress to provide a spring force to move the flow tube 204 in the uphole direction 222. As the flow tube 204 retracts in the uphole direction 222, the flow tube 204 may unblock the recess 212 such that the flapper 208 can rotate from the recess 212 to couple with the seat 216 in the closed position 402. The curvature (e.g., a roulette curve) of the downhole end 218 can slow a closure rate corresponding to adjusting the flow valve 102 from the open position 202 to the closed position 402. The curvature can be concave down such that the downhole end 218 of the flow tube 204 can support the flapper 208 as the flapper 208 rotates into the closed position 402 to slow the closure rate of the flapper 208.

In some aspects, a system, a method, and a flow valve for slowing a closure of the flow valve are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubing string deployable in a wellbore to transport a wellbore fluid; and a flow valve couplable to the tubing string, the flow valve comprising: a flapper positionable to control the wellbore fluid transportable through the tubing string, the flapper being adjustable between an open position and a closed position; and a flow tube positionable in the tubing string, the flow tube comprising a downhole end having a curvature to slow a closure rate corresponding to adjusting the flapper from the open position to the closed position.

Example 2 is the system of example(s) 1, wherein the downhole end of the flow tube further comprises: a first section; and a second section shorter than the first section, wherein the curvature of the downhole end of the flow tube causes the first section of the downhole end to contact the flapper prior to the second section of the downhole end when advancing the flow tube in a downhole direction in the tubing string to adjust the flapper from the closed position to the open position.

Example 3 is the system of example(s) 1-2, wherein the curvature is a first curvature, and wherein the system further comprises: a mating profile defined in a housing of the flow valve to receive the downhole end of the flow tube, wherein the mating profile has a second curvature complementing the first curvature of the downhole end of the flow tube.

Example 4 is the system of example(s) 1-3, wherein, based on the first curvature of the downhole end of the flow tube and the second curvature of the mating profile, the downhole end is couplable to the mating profile to prevent the wellbore fluid transportable via the tubing string from contacting the flapper.

Example 5 is the system of example(s) 1-4, wherein the flapper is supportable by remaining in contact with the downhole end of the flow tube that is retractable in an uphole direction when adjusting the flapper from the open position to the closed position.

Example 6 is the system of example(s) 1-5, wherein the curvature of the downhole end is determinable based on a predefined range associated with the closure rate of the flow valve, and wherein adjusting the flow valve from the open position to the closed position within the predefined range is performable to prevent deformation of the flow valve.

Example 7 is the system of example(s) 1-6, wherein the flapper comprises a first material having a first hardness softer than a second hardness of a second material used to produce the downhole end of the flow tube.

Example 8 is a method comprising: deploying a tubing string downhole in a wellbore to transport a wellbore fluid, the tubing string comprising a flow valve coupled to the tubing string to control the wellbore fluid transported through the tubing string using a flapper adjustable between an open position and a closed position; advancing a flow tube positioned in the tubing string in a downhole direction, the flow tube comprising a downhole end that contacts the flapper to adjust the flow valve from the closed position to the open position; and retracting the flow tube in an uphole direction to adjust the flow valve from the open position to the closed position, the downhole end of the flow tube having a curvature to slow a closure rate corresponding to adjusting the flow valve from the open position to the closed position.

Example 9 is the method of example(s) 8, wherein advancing the flow tube further comprises: contacting the flapper with a first section of the downhole end prior to a second section of the downhole end, wherein the curvature of the downhole end causes the first section of the downhole end to be longer than the second section of the downhole end.

Example 10 is the method of example(s) 8-9, wherein the curvature is a first curvature, and wherein the method further comprises: receiving, by a mating profile defined in a housing of the flow valve, the downhole end of the flow tube, wherein the mating profile has a second curvature complementing the first curvature of the downhole end of the flow tube.

Example 11 is the method of example(s) 8-10, further comprising: coupling, based on the first curvature of the downhole end of the flow tube and the second curvature of the mating profile, the downhole end to the mating profile to prevent the wellbore fluid transportable via the tubing string from contacting the flapper.

Example 12 is the method of example(s) 8-11, wherein retracting the flow tube in the uphole direction further comprises: supporting, via the downhole end of the flow tube, the flapper such that the flapper remains in contact with the flow tube when adjusting the flapper from the open position to the closed position.

Example 13 is the method of example(s) 8-12, wherein determining the curvature of the downhole end is based on a predefined range associated with the closure rate of the flow valve, and wherein adjusting the flow valve from the open position to the closed position within the predefined range prevents deformation of the flow valve.

Example 14 is the method of example(s) 8-13, wherein the flapper comprises a first material having a first hardness softer than a second hardness of a second material used to produce the downhole end of the flow tube.

Example 15 is a flow valve comprising: a flapper positionable in a tubing string to which the flow valve is couplable to control a wellbore fluid transportable through the tubing string, the flapper being adjustable between an open position and a closed position; and a flow tube positionable in the tubing string adjacent to the flapper, the flow tube comprising a downhole end having a curvature to slow a closure rate corresponding to adjusting the flapper from the open position to the closed position.

Example 16 is the flow valve of example(s) 15, wherein the downhole end of the flow tube further comprises: a first section; and a second section shorter than the first section, wherein the curvature of the downhole end of the flow tube causes the first section of the downhole end to contact the flapper prior to the second section of the downhole end when advancing the flow tube in a downhole direction in the tubing string to adjust the flapper from the closed position to the open position.

Example 17 is the flow valve of example(s) 15-16, wherein the curvature is a first curvature, and wherein the flow valve further comprises: a mating profile defined in a housing of the flow valve to receive the downhole end of the flow tube, wherein the mating profile has a second curvature complementing the first curvature of the downhole end of the flow tube.

Example 18 is the flow valve of example(s) 15-17, wherein, based on the first curvature of the downhole end of the flow tube and the second curvature of the mating profile, the downhole end is couplable to the mating profile to prevent the wellbore fluid transportable via the tubing string from contacting the flapper.

Example 19 is the flow valve of example(s) 15-18, wherein the flapper is supportable by remaining in contact with the downhole end of the flow tube that is retractable in an uphole direction when adjusting the flapper from the open position to the closed position.

Example 20 is the flow valve of example(s) 15-19, wherein the curvature of the downhole end is determinable based on a predefined range associated with the closure rate of the flow valve, and wherein adjusting the flow valve from the open position to the closed position within the predefined range prevents deformation of the flow valve.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing string deployable in a wellbore to transport a wellbore fluid; and a flow valve couplable to the tubing string, the flow valve comprising:

a flapper positionable to control the wellbore fluid transportable through the tubing string, the flapper being adjustable between an open position and a closed position; and a flow tube positionable in the tubing string, the flow tube comprising a downhole end having a curvature to slow a closure rate corresponding to adjusting the flapper from the open position to the closed position, wherein the curvature of the downhole end corresponds to a roulette curve.

2. The system of claim 1, wherein the downhole end of the flow tube further comprises:

a first section; and a second section shorter than the first section, wherein the curvature of the downhole end of the flow tube causes the first section of the downhole end to contact the flapper prior to the second section of the downhole end when advancing the flow tube in a downhole direction in the tubing string to adjust the flapper from the closed position to the open position.

3. The system of claim 1, wherein the curvature is a first curvature, and wherein the system further comprises:

a mating profile defined in a housing of the flow valve to receive the downhole end of the flow tube, wherein the mating profile has a second curvature complementing the first curvature of the downhole end of the flow tube.

4. The system of claim 3, wherein, based on the first curvature of the downhole end of the flow tube and the second curvature of the mating profile, the downhole end is couplable to the mating profile to prevent the wellbore fluid transportable via the tubing string from contacting the flapper.

5. The system of claim 1, wherein the flapper is supportable by remaining in contact with the downhole end of the flow tube that is retractable in an uphole direction when adjusting the flapper from the open position to the closed position.

6. The system of claim 1, wherein the curvature of the downhole end is determinable based on a predefined range associated with the closure rate of the flow valve.

7. The system of claim 1, wherein the flapper comprises a first material having a first hardness harder than a second hardness of a second material of the downhole end of the flow tube.

8. A method comprising:

deploying a tubing string downhole in a wellbore to transport a wellbore fluid, the tubing string comprising a flow valve coupled to the tubing string to control the wellbore fluid transported through the tubing string using a flapper adjustable between an open position and a closed position;

advancing a flow tube positioned in the tubing string in a downhole direction, the flow tube comprising a downhole end that contacts the flapper to adjust the flow valve from the closed position to the open position; and retracting the flow tube in an uphole direction to adjust the flow valve from the open position to the closed position, the downhole end of the flow tube having a curvature to slow a closure rate corresponding to adjusting the flow valve from the open position to the closed position, wherein the curvature of the downhole end corresponds to a roulette curve.

9. The method of claim 8, wherein advancing the flow tube further comprises:

contacting the flapper with a first section of the downhole end prior to a second section of the downhole end, wherein the curvature of the downhole end causes the first section of the downhole end to be longer than the second section of the downhole end.

10. The method of claim 8, wherein the curvature is a first curvature, and wherein the method further comprises:

receiving, by a mating profile defined in a housing of the flow valve, the downhole end of the flow tube, wherein the mating profile has a second curvature complementing the first curvature of the downhole end of the flow tube.

11. The method of claim 10, further comprising:

coupling, based on the first curvature of the downhole end of the flow tube and the second curvature of the mating profile, the downhole end to the mating profile to prevent the wellbore fluid transportable via the tubing string from contacting the flapper.

12. The method of claim 8, wherein retracting the flow tube in the uphole direction further comprises:

supporting, via the downhole end of the flow tube, the flapper such that the flapper remains in contact with the flow tube when adjusting the flapper from the open position to the closed position.

13. The method of claim 8, wherein determining the curvature of the downhole end is based on a predefined range associated with the closure rate of the flow valve.

14. The method of claim 8, wherein the flapper comprises a first material having a first hardness harder than a second hardness of a second material of the downhole end of the flow tube.

15. A flow valve comprising:

a flapper positionable in a tubing string to which the flow valve is couplable to control a wellbore fluid transportable through the tubing string, the flapper being adjustable between an open position and a closed position; and a flow tube positionable in the tubing string adjacent to the flapper, the flow tube comprising a downhole end having a curvature to slow a closure rate corresponding to adjusting the flapper from the open position to the closed position, wherein the curvature of the downhole end corresponds to a roulette curve.

16. The flow valve of claim 15, wherein the downhole end of the flow tube further comprises:

a first section; and a second section shorter than the first section, wherein the curvature of the downhole end of the flow tube causes the first section of the downhole end to contact the flapper prior to the second section of the downhole end when advancing the flow tube in a downhole direction in the tubing string to adjust the flapper from the closed position to the open position.

17. The flow valve of claim 15, wherein the curvature is a first curvature, and wherein the flow valve further comprises:

a mating profile defined in a housing of the flow valve to receive the downhole end of the flow tube, wherein the mating profile has a second curvature complementing the first curvature of the downhole end of the flow tube.

18. The flow valve of claim 17, wherein, based on the first curvature of the downhole end of the flow tube and the second curvature of the mating profile, the downhole end is couplable to the mating profile to prevent the wellbore fluid transportable via the tubing string from contacting the flapper.

19. The flow valve of claim 15, wherein the flapper is supportable by remaining in contact with the downhole end of the flow tube that is retractable in an uphole direction when adjusting the flapper from the open position to the closed position.

20. The flow valve of claim 15, wherein the curvature of the downhole end is determinable based on a predefined range associated with the closure rate of the flow valve.

* * * * *